United States Patent [19]

Mims

[11] 4,155,549

[45] May 22, 1979

[54] POOL BALL SORTING APPARATUS

[75] Inventor: Donald B. Mims, Grand Prairie, Tex.

[73] Assignees: William G. Rickett; John H. Lewis, Jr., both of Arlington, Tex. ; part interest to each

[21] Appl. No.: 667,102

[22] Filed: Mar. 15, 1976

[51] Int. Cl.[2] ..... A63D 15/00; B07B 13/10

[52] U.S. Cl. ..... 209/645; 273/11 R

[58] Field of Search ..... 273/59 R, 59 A, 59 B, 273/11 R, 11 C, 14, 2, 171, 63 E; 209/121

[56] References Cited

U.S. PATENT DOCUMENTS

| | | | |
|---|---|---|---|
| 395,793 | 1/1889 | Moore | 209/121 |
| 575,128 | 1/1897 | Rockwell | 273/63 E |
| 680,759 | 8/1901 | Briggs | 273/11 C |
| 1,016,850 | 2/1912 | Perkins | 209/121 |
| 1,791,096 | 2/1931 | Humphrey | 209/121 |
| 3,140,093 | 7/1964 | Singer | 273/11 R |
| 3,224,766 | 12/1965 | Vincent | 209/121 X |

FOREIGN PATENT DOCUMENTS

| | | | |
|---|---|---|---|
| 667451 | 6/1929 | France | 209/121 |
| 1199060 | 6/1959 | France | 209/121 |
| 2030 | 10/1917 | Netherlands | 209/121 |

*Primary Examiner*—Richard C. Pinkham
*Assistant Examiner*—Arnold W. Kramer
*Attorney, Agent, or Firm*—Richards, Harris & Medlock

[57] ABSTRACT

Pool game apparatus having homogenous spherical balls of identical size including a cue ball of slightly higher specific gravity than the specific gravity of the object balls; a pool table internally carries a sorting device for the balls having a chute with a deflectable weighing plate pivotable about an axis parallel to the chute and having a trailing edge at an acute angle to the chute; the weighing plate is counterbalanced to remain stationary when an object ball passes over it, but to deflect on passage of the heavier cue ball so that the cue ball is diverted to the side of the path followed by the object balls by a stationary diverter plate adjacent the trailing edge; the chute floor is slanted to one side of the chute axis and is provided with a side support member so that a ball passing onto the weighing plate is supported by the floor and by the side support member. The sorting action is effected not only by the diverter plate, but also by the change in slope of the weighing plate and the force of the side support member on the ball as the plate drops.

7 Claims, 11 Drawing Figures

POOL BALL SORTING APPARATUS

This invention relates to pool game apparatus and more particularly to a sorting device and set of pool balls usable therewith for separation of the cue ball from the object balls within a pool table so that object balls are guided along one path to an inaccessible location while the cue ball is returned to the players.

The invention has particular application to coin-operated pool tables. A large number of coin-operated pool tables have been made, and are being made, in the United States, providing a pool game facility to paying users at amusement centers or the like. The basic mode of operation of a coin-operated pool table requires that the object balls to be utilized in the pool game be retained in an interior storage compartment in the table until insertion of a coin or coins actuating a mechanism to release the object balls for use by the players. In subsequent play of a game of pool by the players, object balls shot into the pockets are returned to the inaccessible storage compartment to be retained there until the coin-operated mechanism is once again actuated by the user.

In such devices, it is necessary that the pool game apparatus have the capability of distinguishing between the cue ball and the object balls, so that the cue ball will not pass to the inaccessible storage compartment if it is deposited in one of the table pockets. In the coin-operated pool industry, there are basically two approaches presently being taken to this problem. One requires the use of an oversized cue ball, with means provided in the table for diverting the oversized cue ball and returning it to an accessible location on the exterior of the table. Size discrimination systems such as this require play with a cue ball which is larger (or alternatively smaller) than the object balls. This is an objectionable feature, since the usual game of pool is played with a cue ball of identical size to the object balls.

The second type of system utilized in present day coin-operated pool tables is a magnetic system. Typically, the cue ball is provided with a magnetizable insert so that a magnet carried inside the table will draw the cue ball away from the track followed by the object balls. While such systems may be fairly reliable and do permit balls to be of identical size, the cue ball in such systems is more subject to shattering when dropped on a hard surface because of the discontinuity of a metal insert in the core. Moreover, it is difficult to achieve balance for true roll in such a cue ball, and fabrication is expensive.

The invention resides both in the provision of a novel sorting device for reliably detecting a slight weight differential of the cue ball vis-a-vis an object ball and preventing its passage to the inaccessible storage compartment and in a novel set of pool balls for use therewith. The novel balls to be used are of uniform size and are homogenous, with the cue ball being slightly larger in weight.

The invention disclosed herein is believed to materially increase the acceptability of coin-operated pool tables by improving the equipment used in play of the game and by providing a reliable sorting technique. The sorting device of this invention represents a distinct improvement over weight differentiating ball sorting techniques disclosed in prior art patents such as U.S. Pat. Nos. 680,759, 1,888,673, 1,791,096 and 3,224,766, which have not found acceptance in the coin-operated pool table industry.

A set of spherical pool balls may be used in conjunction with applicant's sorting device in which the balls are of identical size. The set preferably includes a plurality of solid homogenous object balls having a first weight and being formed from a material of a first specific gravity, and a solid homogenous cue ball of the same size, but having a greater weight than each of the object balls, and being formed from a material of a second specific gravity higher than the first specific gravity.

A sorting device is utilized in conjunction with these balls which includes a chute for receiving balls along a predetermined path, a deflectable weighing plate forming a portion of the floor of the chute in such path, and means for automatically deflecting to one side of such path a ball rolling over the weighing plate which exceeds a predetermined weight.

In a more specific aspect of the invention, the weighing plate is pivotable about an axis parallel to the chute, and biasing means are provided which normally maintain the weighing plate in a first position when a lighter one of said balls traverses the pivot plate, but permit the weighing plate to pivot from said first position under the weight of a heavier one of said balls to divert the heavier ball from the path of the lighter ball.

In accordance with a preferred form of the invention, the weighing plate is provided with a trailing edge along a line defining an acute angle with the path of the balls as they enter the plate. A stationary diverter immediately adjacent the trailing edge along the line defining such acute angle operates to divert heavier balls when the weighing plate is depressed.

The invention also contemplates that the ball be provided with support means for supporting each ball at a minimum of two rolling support points in the chute which are on opposite sides of a vertical line through the center of gravity of the ball as the ball begins its traverse of the weighing plate. Deflection of the weighing plate then results in the deflection of one of such support points.

In a specific embodiment of the invention, the sorting chute is provided with a floor slanted to one side of the chute and at least one side support so that the ball is supported by the floor of the chute and such side support along a predetermined path. The deflection of the weighing plate acts to send the heavier balls into a second path defined by path means provided in the sorting chute.

For a more complete understanding of the present invention and for further objects and advantages thereof, reference may now be had to the following description taken in conjunction with the accompanying drawings, in which.

Figure 1:
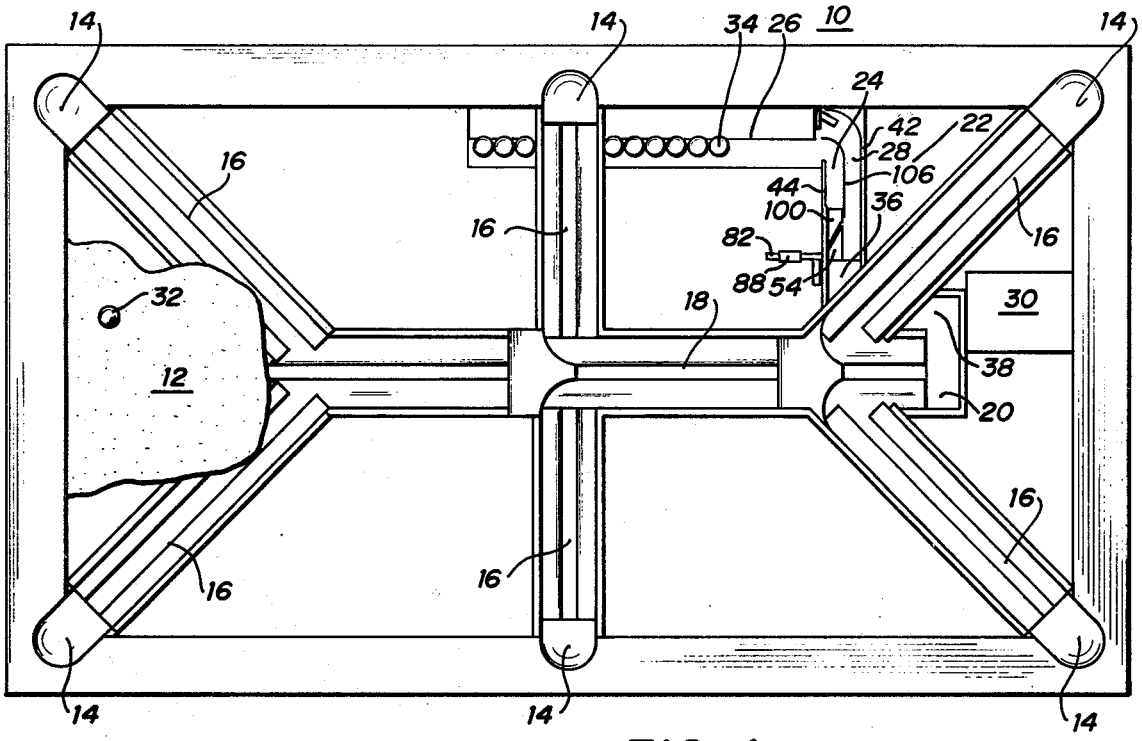
FIG. 1 is a plan view, partially cut away, of a pool table incorporating pool ball sorting apparatus, including a novel set of pool balls, which embodies the present invention.
Figure 4:
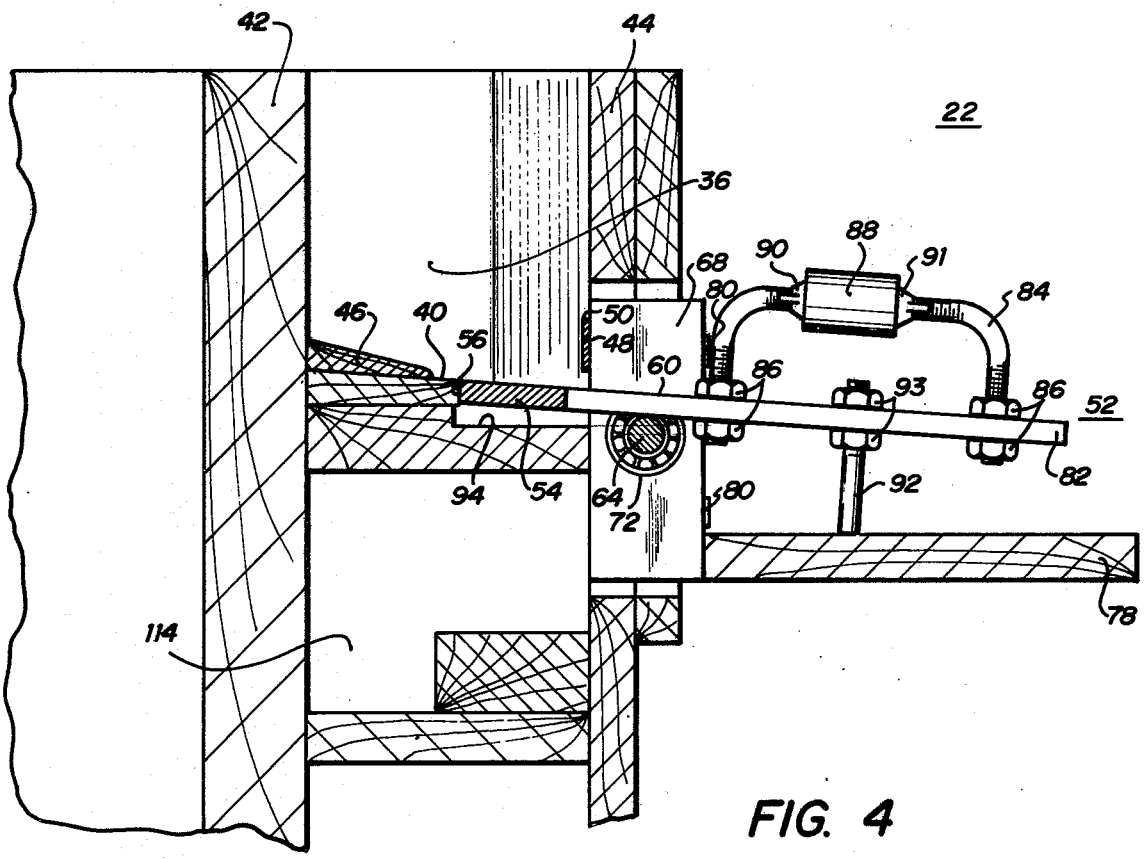
FIG. 4 is a cross-section taken along the line 4—4 in FIG. 3.
Figure 2:
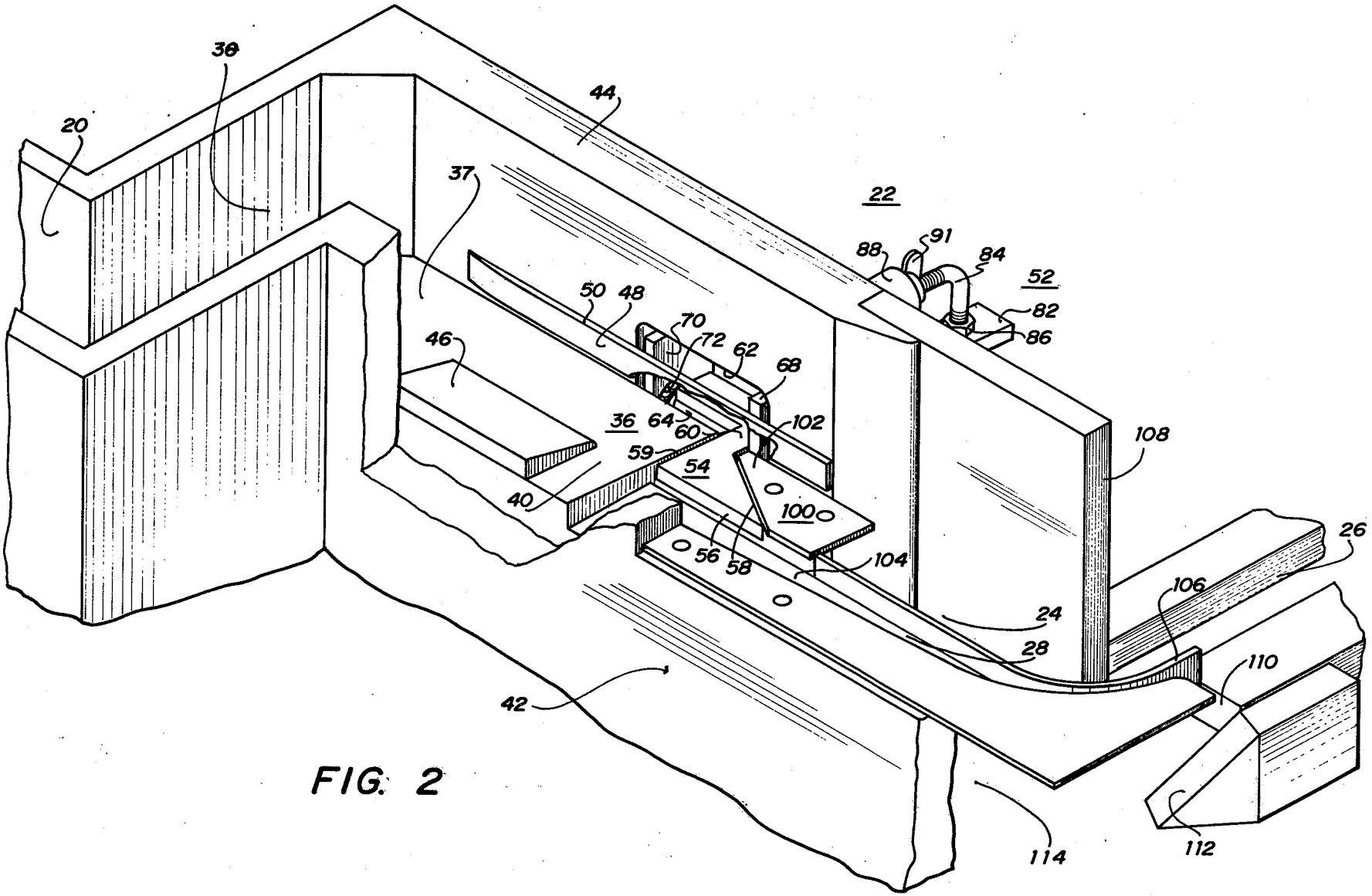
FIG. 2 is a perspective view of the sorting device of the apparatus shown in FIG. 1.
Figure 3:
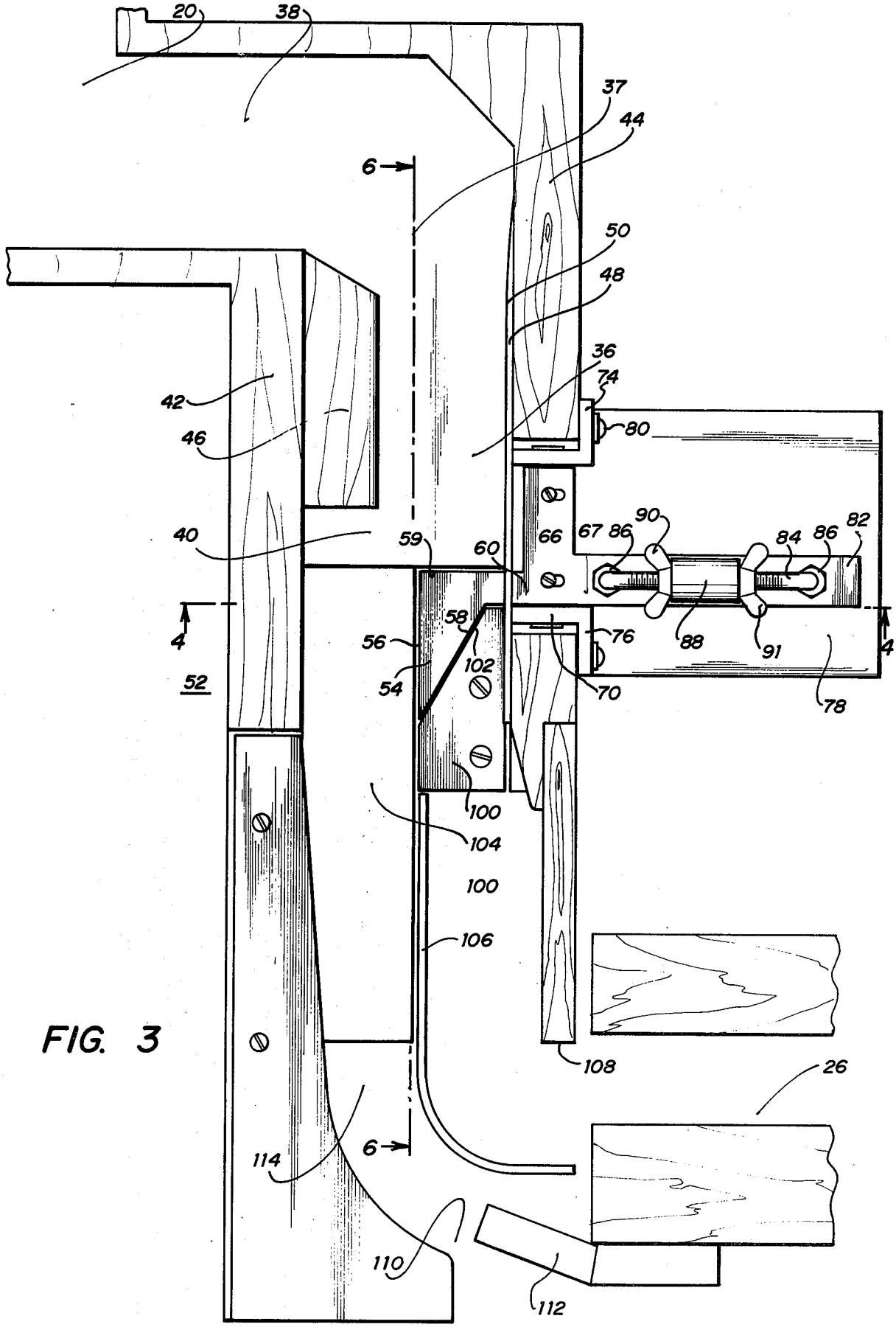
FIG. 3 is a plan view of the sorting device shown in FIG. 2.
Figure 5:
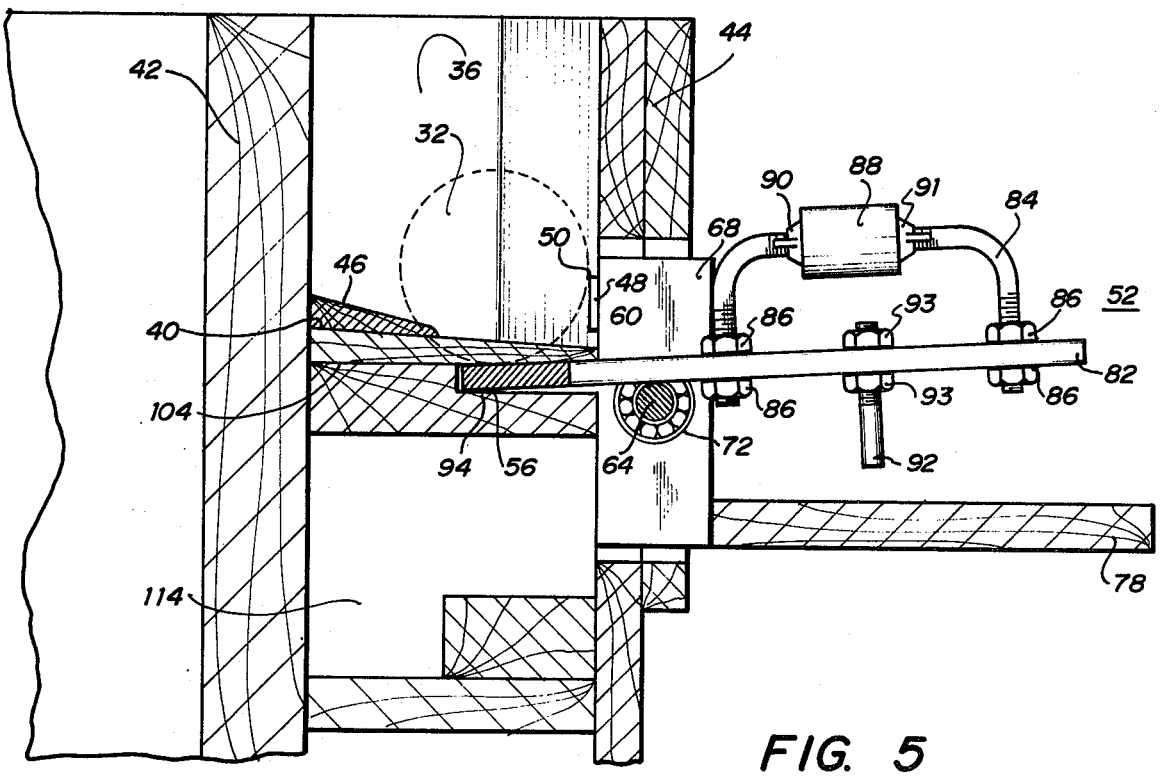
FIG. 5 is a cross-section view similar to FIG. 4, with the weighing plate of the sorting device in depressed position to divert a heavier ball.
Figure 6:
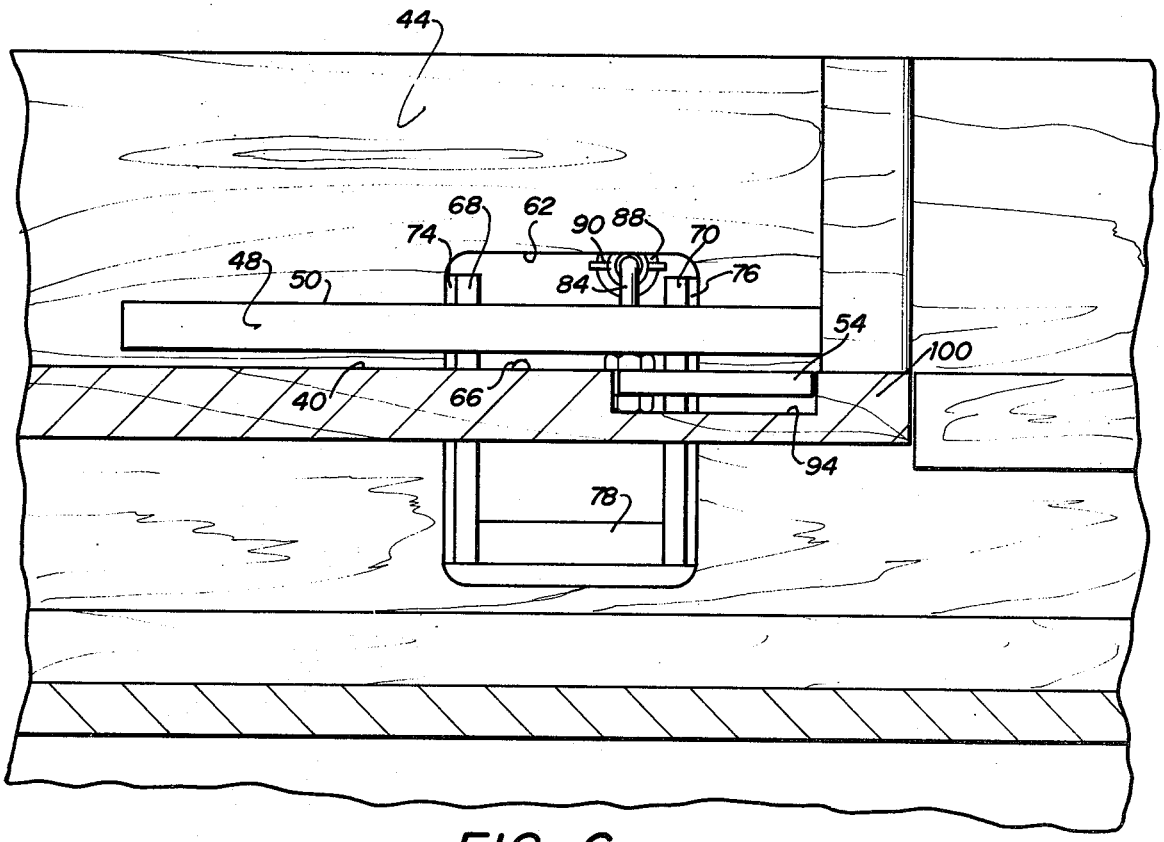
FIG. 6 is a cross-section taken along the line 6—6 in FIG. 3.

Pool game apparatus embodying the present invention may be utilized, as shown in FIG. 1, in conjunction with a six pocket pool table indicated by the reference numeral 10. Table 10 is provided in the conventional manner with a playing surface 12 and pockets 14 located at the corners of the table and intermediate the sides. A ball chute 16 under the surface 12, internally of the table, is associated with each of the pockets 14. The chutes 16 are adapted to carry balls deposited in the pockets by gravity away from the pockets to a central collection tray 18. Collection tray 18 gravity feeds the balls into a chute 20 which leads to the sorting device generally indicated by the reference numeral 22. Two paths lead from the sorting device 22. A first path 24 communicates with the inaccessible object ball storage compartment 26. Storage compartment 26 is provided in a well known manner with a coin-operated mechanism (not shown) to release object balls for play only upon deposit of coins. The second path 28 from the sorting device 22 leads to an accessible area 30 for receipt of the cue ball. Area 30 has open access from outside the table so that the players may return the cue ball to the playing surface 12. A set of pool balls for use in this invention is illustrated in FIG. 1, and includes a uniform homogenous spherical cue ball 32 and a plurality (the normal number being 15) of object balls 34. Object balls 34 are uniform, homogenous and spherical, being the same size as the cue ball 32, and having the usual object ball markings.

The object balls 34 are preferably formed from the phenolic resin customarily used for the manufacture of pool balls. The balls may be of the standard size and weight accepted in the industry, that is, approximately $2\frac{1}{4}$ inches in diameter and approximately 165 grams in weight. The cue ball should be formed from a similar material having a slightly higher specific gravity. Cue ball 32 is of identical size to the object balls 34. The difference in weight of cue ball 32 and each object ball 34 may be relatively small. Since standard pool ball sets have all balls of the same weight, it is desirable to come as close as possible to the same weight while maintaining sufficient weight differential to insure reliable sorting. A sorting device constructed in accordance with this invention has reliably operated to sort a cue ball along the second path 28 and the object balls along first path 24 with a weight differential on the order of 1%. Accordingly, the cue ball may weigh on the order of 167 grams.

One form of the sorting device 22 is illustrated in more detail in FIGS. 2–6. Sorting device 22 has a sorting chute 36, the inlet 37 of which is connected through a transverse chute 38 to the outlet of ball chute 20 to form a continuous path of travel by gravity for balls entering chute 20 from the collection tray 18. The continuous path thus formed by ball chute 20, transverse chute 38, and sorting chute 36 slopes continuously downwardly along its axes indicated by the arrows shown in FIG. 3. Inlet 37 of sorting chute 36 is defined by a floor 40 and side walls 42 and 44. Sorting chute floor 40, in addition to being sloped along its axis for travel of the ball along the chute is sloped slightly downwardly in the direction of wall 44. A wedge-shaped guide block 46 is positioned on floor 40 in the inlet 37 along wall 42 to cause balls to traverse the side of chute 36 adjacent wall 44. A side support member 48 is secured to the inside of wall 44 above the level of floor 40 to present an upper support shoulder 50 for supporting balls traversing chute 36. Alternatively, the wall and side support member could be formed to present a side support surface at an angle to the vertical, to support the balls, rather than a shoulder such as shoulder 50.

Sorting chute 36 is provided with a weighing station generally indicated by the reference numberal 52. Weighing station 52 includes a deflectable weighing plate 54 which is normally positioned coplanar with floor 40 so that it forms a portion of the floor of sorting chute 36 adjacent wall 44. Weighing plate 54 extends outwardly to an outer edge 56 a sufficient distance from wall 44 such that a ball rolling along sorting chute 36 supported by side support 50 and floor 40 will roll on to weighing plate 54. Leading edge 59 of weighing plate 54 is closely aligned with the edge of floor 40 to provide a relatively smooth rolling support across them. Plate 54 has a trailing edge 58 lying along a line at an acute angle to the longitudinal axis of chute 36 and thus to the line of travel of a ball rolling onto weighing plate 54. The weighing plate 54 is small enough that only one ball traveling along the chute 36 may bear on plate 54 at any one time.

Weighing plate 54 is carried integrally on a pivot arm 60 which extends through an aperture 62 in side wall 44. Pivot arm 60 is secured to a pivot shaft 64 by fastening means such as screws 66 placed through slots 67 on arm 60. Shaft 64 is rotatably journalled parallel to chute 36 in upstanding brackets 68 and 70 positioned at either end of shaft 66, by means of ball bearings 72 provided between shaft 64 and the brackets 68 and 70.

Brackets 68 and 70 may be integrally formed with mounting flanges 74 and 76, and with horizontal pivot stop plate 78 extending outwardly from wall 44. Such unitary member comprising the shaft support brackets 68 and 70, flanges 74 and 76 and pivot stop 78, which may be formed from a light metal such as aluminum, may be secured in position on the sorting device 22 by means of screws 80 secured through mounting flanges 74 and 76 to the outside of wall 44.

The pivot arm 60 includes an elongated lever arm 82 on the end of pivot arm 60 remote from weighing plate 54. Lever arm 82 carried a U-shaped threaded adjustable counterweight holder 84 secured in position on lever arm 82 by suitable means such as nuts 86. Biasing means for the weighing plate 54 in the form of a counterweight 88 is carried by holder 84. Adjustment nuts 90 and 91 are threaded onto holder 84 at either end of counterweight 88 for the purpose of securing counterweight 88 in position at any selected location along holder 84.

Extending downwardly from lever arm 82 is a stop bolt 92 threaded through a hole in lever arm 82. Nuts 93 are used to adjustably secure stop bolt 92 in the appropriate position for engagement of stop bolt 92 with pivot stop 78 when weighing plate 54 is properly aligned in coplanar relationship with the floor 40 of chute 36. A stop floor 94 to limit excessive pivoting in the opposite direction underlies weighing plate 54.

A stationary diverter 100 is positioned in chute 36 downstream of the trailing edge 58 of weighing plate 54. The forward edge 102 of diverter plate 100 is closely aligned with the normal position of trailing edge 58 of weighing plate 54, and thus is coplanar with floor 40. Thus, in the normal position of weighing plate 54 illustrated in FIG. 4, for example, the floor 40, weighing plate 54 and diverter 100 form an almost continuous and coplanar rolling surface for lower supporting of a ball rolling along chute 36 also supported on shoulder 50 of side support member 48, thus defining the portion of the first path 24.

Adjacent the weighing plate 54 and diverter 100 and lying along wall 42 is a drop floor portion 104 of chute 36 which defines a portion of the second path 28. The drop floor portion is in vertical cross-section transverse to the chute 36, horizontal and below floor 40. Immediately downstream of diverter plate 100 is a separator rail 106 running alongside drop floor 104, dividing chute 36 into the two separate paths, the first path passing between wall 44 and separator rail 106 and the second path passing between wall 42 and separator rail 106.

Beyond the end 108 of wall 44, the separator rail 106 curves through a ninety degree turn so that path 24 turns into the inaccessible storage compartment 26. At such turn, wall 42 terminates so that a cue ball drop 110 is formed. Cue ball receiving block 112 is interposed in drop 110, to guide the cue ball to its accessible open area 30 along a chute 114 under floor 40.

The sorting device 22 is readied for operation by aligning and adjusting the pivot arm 60 for proper position and biasing. Adjustment nuts 93 on stop bolt 92 are adjusted so that weighing plate 54 is aligned with the plane of floor 40 and diverter 100 when the pivot stop bolt 92 engages pivot stop plate 78. The side-to-side position of plate 54 may be adjusted by sliding of the slots 67 on screws 66. Counterweight 88 is positioned by wing nuts 90 and 91 so that the lighter object balls 34 do not deflect weighing plate 54 when passing thereover, while the heavier cue ball does so that it is diverted onto drop floor portion 104 and into path 28.

Figure 7:
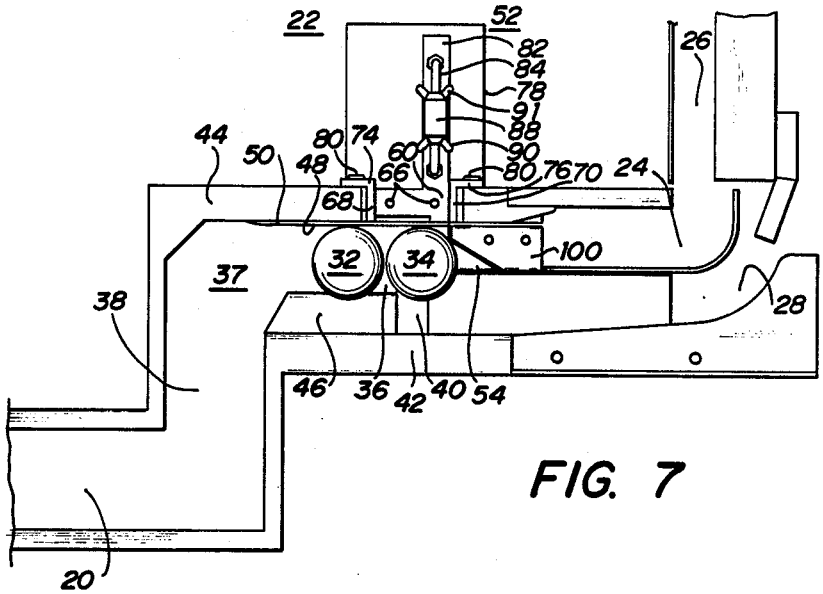
FIGS. 7–9 are sequential plan views similar to FIG. 3, illustrating the sorting of two balls of different weights passing through the sorting device.
Figure 8:
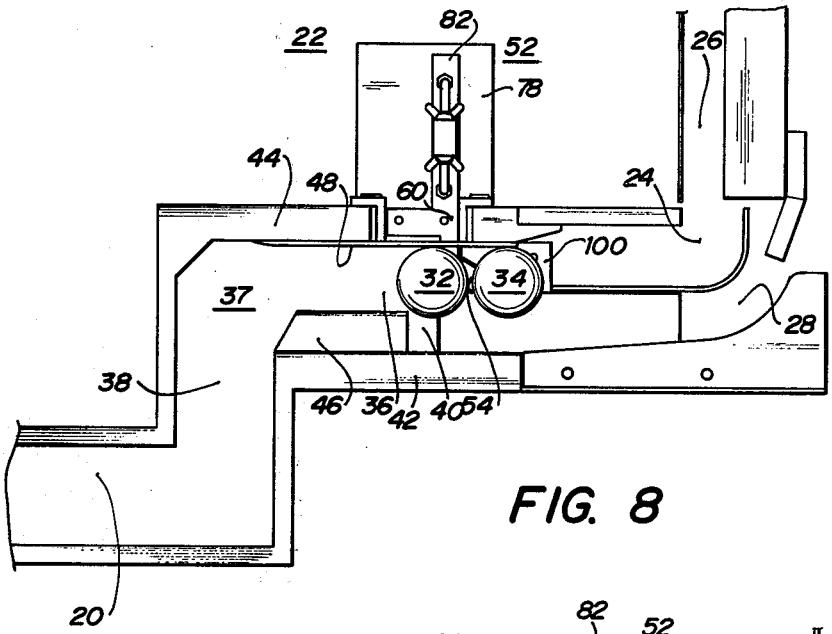
Figure 9:
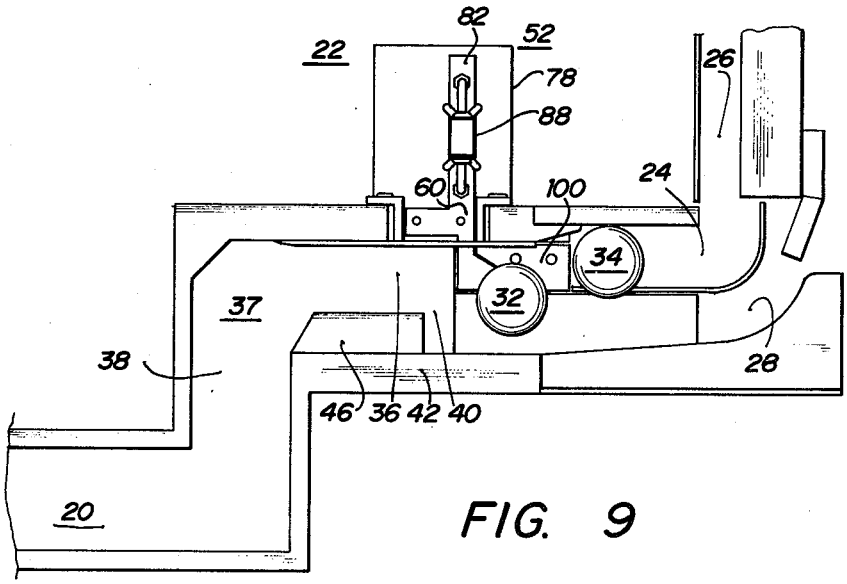

The automatic sorting operating of sorting device 22 is illustrated sequentially in FIGS. 7–9. The sorting device of this invention is capable of sorting balls which are aligned in contact passing into the device as illustrated in FIG. 7. There, a lighter object ball 34 is followed immediately by cue ball 32 in chute 36. The velocity of the balls in the direction of the axis of chute 36 is reduced to a negligible level by the transverse chute 38 and the interaction of the balls with block 46 and walls 42 and 44. As indicated in FIG. 9, the object ball passes over plate 54 without being diverted, since its weight is insufficient to overcome the counterforce on pivot arm 60 to depress plate 54. In FIG. 8, the object ball 34 has left plate 54 and passed onto diverter 100, before cue ball 32 reaches plate 54.

In FIG. 9, the depression of plate 54 by cue ball 32 has caused cue ball 32 to be diverted into drop floor 104. While the principal agent acting on cue ball 32 to divert it is the leading edge of diverter 100, the supporting shoulder 50 under the ball adjacent wall 44 also assists in the diversion as plate 54 drops, and the tilting of plate 54 toward wall 42 enters into it as well.

Figure 11:
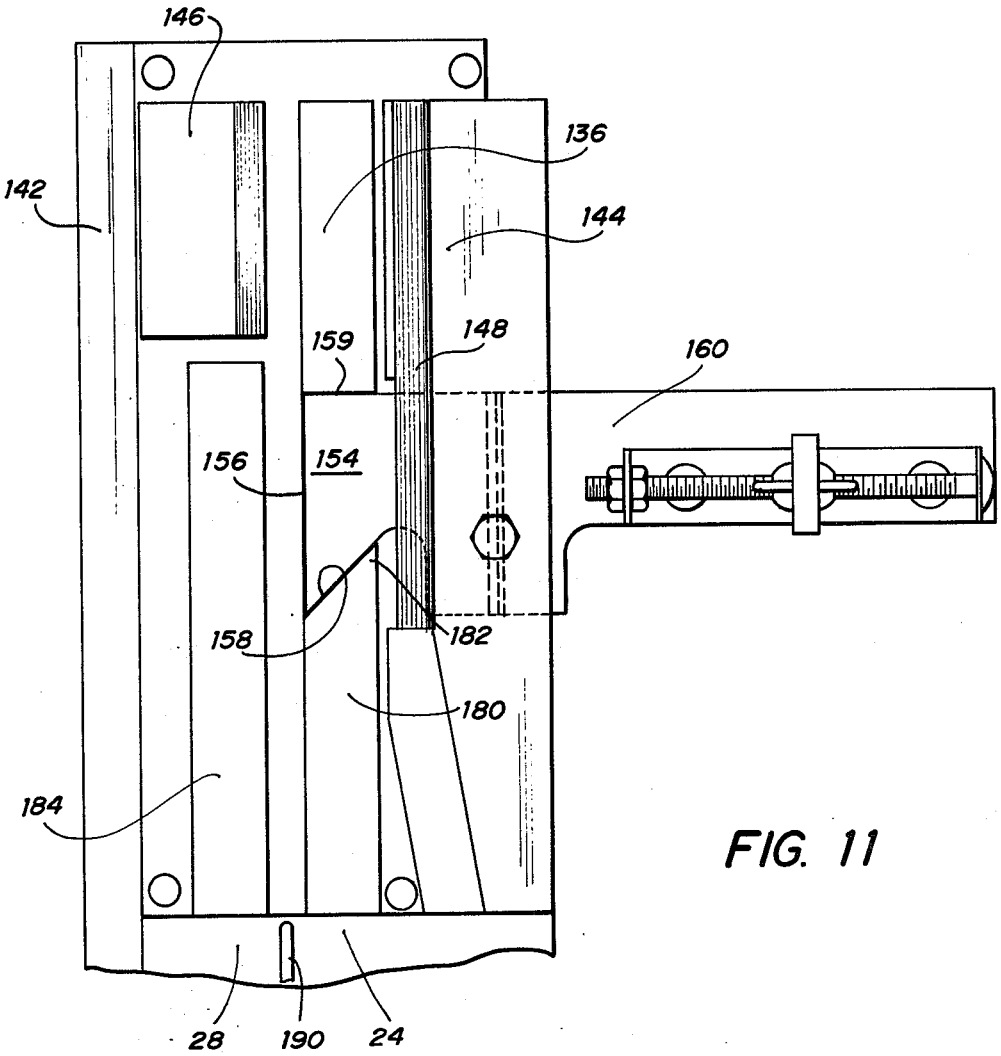
FIG. 11 is a plan view of the modified form of sorting device shown in FIG. 10.
Figure 10:
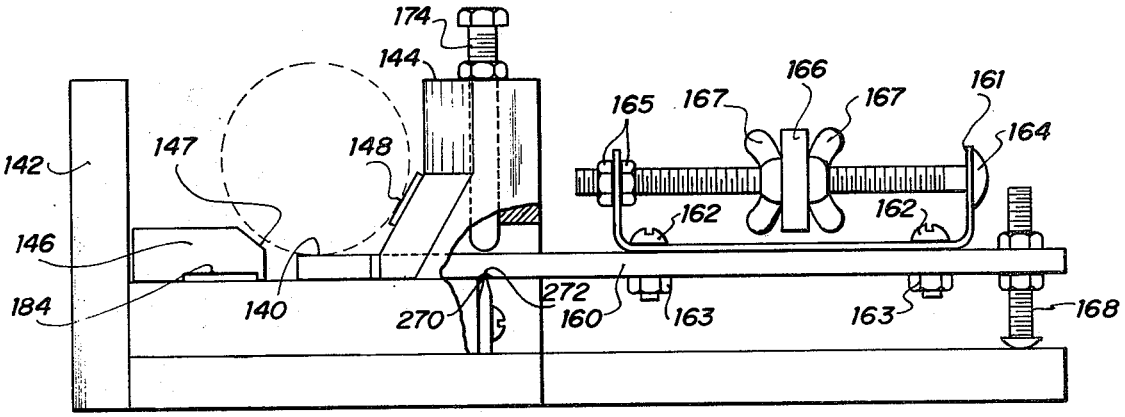
FIG. 10 is a cross-sectional view similar to FIG. 4 illustrating a modified form of sorting device.

A modified form of sorting device 22 is illustrated in FIGS. 10 and 11. The basic sorting action of the embodiment illustrated in those figures is the same. The object balls are permitted to pass along the first path 24 and the cue ball is diverted to the second path 28. All of the balls pass into the sorting device through the sorting chute 136, which is provided with a floor 140 and side walls 142 and 144. A guide block 146 having an angled guide surface 147 diverts the balls to the side of chute 136 adjacent side wall 144.

The lower portion of side wall 144 is sloped inwardly toward floor 140, the lower sloped portion being provided with side support member 148. A pivotable weighing plate 154 is positioned in the path of the balls as they pass along the floor 140 supported by floor 140 and side support member 148. Floor 140 is slanted toward wall 144.

Weighing plate 154 is carried on pivot arm 160 which extends through side wall 144. Weighing plate 154 is normally positioned so as to be coplanar with floor 140, and has an outer edge 156 a sufficient distance from wall 144 so that balls will automatically pass over weighing plate 154. The trailing edge 158 of plate 154 is at an acute angle to the path of travel of the balls. Leading edge 159 of plate 154 is closely adjacent floor 140 so that there is a relatively smooth continuous path of travel in the transition between floor 140 and plate 154 in its normal position.

Pivot arm 160 carries counterweight mounting means for an adjustable counterweight. These means include a bracket 161 secured to the pivot arm 160 by bolts 162 and nuts 163. Bracket 161 carries a threaded bolt 164 maintained in position by nuts 165. The counterweight 166 is mounted on bolt 164 and may be adjusted along the length of bolt 164 and secured into a desired position by wing nuts 167. An adjustable stop bolt 168 is carried by pivot arm 160 so that pivot arm 160 may be adjusted for use to a position with floor 140.

The pivot for pivot arm 160 is a knife edge 270 extending upwardly into a complementary notch 272 on the underside of pivot arm 160. A retainer bolt 174 having a rounded end extends downwardly through wall 144 into a position immediately adjacent the top surface of pivot arm 160 over the knife edge 270, so that the pivot arm 160 is maintained in position on the knife edge 270.

A stationary diverter plate 180 having leading edge 182 at an acute angle to the axis of chute 136 is closely aligned with the trailing edge 158 of plate 154, and diverter plate 180 is coplanar with the normal position of weighing plate 154 and with floor 140.

A drop floor portion 184 at an elevation lower than floor 140 is provided on the side of chute 136 adjacent wall 142 opposite the weighing station and downstream thereof, leading to one side of rail 190 which divides chute 136 into the object ball path 24 and cue ball path 28.

The operation of the modified form of sorting device illustrated in FIGS. 10 and 11 is substantially the same as that described in conjunction with the sorting device shown in FIGS. 2–9. Actual physical embodiments of both forms of the device have been constructed. It is believed that the device constructed in accordance with FIGS. 10 and 11 is preferable in that the best sorting reliability on balls having a relatively small weight differential has been accomplished utilizing that form of device.

Having described the invention in connection with certain specific embodiments thereof, it is to be understood that further modifications may now suggest themselves to those skilled in the art and it is intended to cover such modifications as fall within the scope of the appended claims.

What is claimed is:

1. Apparatus for sorting heavier balls weighing more than a predetermined weight from lighter balls weighing no more than such predetermined weight comprising:

a chute for the balls having a transversely slanted floor;

a weighing plate forming a portion of the floor of the chute and being pivotable about an axis parallel to the chute; and biasing means maintaining the weighing plate in a first position aligned with the transversely slanted chute floor when a lighter one of said balls traverses the pivot plate, but permitting the weighing plate to pivot from said first position under the weight of a heavier one of said balls to a second position having an opposite transverse slant to divert the heavier ball from the path of the lighter ball.

2. Ball sorting apparatus for sorting balls of different weights along two different paths comprising:

a chute adapted to guide the balls along a first predetermined path;

a pivotable weighing plate interposed in such path;

stationary side support means on one side of the chute adjacent the weighing plate supporting each such rolling ball; and biasing means which permit the lighter of such balls to continue across such plate supported at two points without deflecting the weighing plate, while permitting the weighing plate to be pivoted by the heavier of such balls so that the portion of the plate spaced from the side support means is lowered with respect to the portion of the plate closest to the side support means to divert such heavier balls to one side of the first path into a second path spaced farther from said stationary side support means than said first path.

3. Ball sorting apparatus for sorting balls exceeding a predetermined weight from balls each having a weight less than the weight comprising:

a sorting chute adapted to receiving such balls along a predetermined path;

side support means on one side of the chute for supporting a ball rolling in the chute;

a deflectable weighing plate in the chute in the path of such balls having a trailing edge along a line defining an acute angle with the path of the balls as they enter the plate, said line diverging from the side support means;

a stationary diverter immediately adjacent the trailing edge of the weighing plate along such line defining an acute angle; and biasing means maintaining the weighing plate normally aligned with the stationary diverter at all times except when the heavier of such balls traverses the plate, so that lighter balls are undeflected by the diverter, and permitting deflection of the weighing plate when the weighing plate is traversed by a heavier ball so that such ball is deflected by the diverter.

4. Apparatus for sorting balls by weight comprising a chute for receiving balls along a predetermined path and deflection means in the chute for deflecting balls in excess of a predetermined weight to the side of the predetermined path, said deflection means including:

stationary support means on the side of the chute opposite the side to which such deflection is to be made, such support means adapted to provide a rolling support for a ball rolling in the chute;

pivotable weighing plate means forming a portion of the floor of the chute in such path and being pivotable about an axis parallel to the chute and on the same side of the chute as the stationary support means; and means permitting the weighing plate to pivot downwardly on passage of a ball which exceeds a predetermined weight so that such a ball is diverted to the side.

5. Apparatus for sorting balls by weight comprising a chute for receiving balls along a predetermined path and deflection means in the chute for deflecting balls in excess of a predetermined weight to only one side of the predetermined path, said deflection means including:

stationary support means on the side of the chute opposite the side to which such deflection is to be made, such support means adapted to provide a rolling support for a ball rolling in the chute;

deflectable weighing plate means forming a portion of the floor of the chute in such path; and means permitting the weighing plate to move downwardly on passage of a ball which exceeds a predetermined weight so that such a ball is diverted in only one sideward direction away from the stationary support means.

6. Apparatus for sorting balls by weight comprising:

a chute having an entrance for receiving the balls;

first path means spaced from the chute entrance defining a first path for balls weighing no more than a predetermined weight;

second path means defining a second path parallel to the first path and in side-by-side relationship to the first path, for balls exceeding the predetermined weight; and sorting means interposed between the upper end of the chute and the upper end of said first and second path means, comprising a counterweighted deflectable weighing plate means adapted to remain stationary on passage of a ball not exceeding the predetermined weight to cause it to enter the first path, and adapted to deflect on passage of a ball which exceeds the predetermined weight so as to divert such a ball to the side to enter the second path.

7. Ball sorting apparatus for sorting balls exceeding a predetermined weight from balls each having a lesser weight comprising:

a sorting chute adapted to receiving such balls along a predetermined path;

a deflectable weighing plate in the chute in the path of such balls having a trailing edge along a line defining an acute angle of less than 45 degrees with the path of the balls as they enter the plate;

a stationary diverter immediately adjacent the trailing edge of the weighing plate along such line defining an acute angle; and biasing means maintaining the weighing plate normally aligned with the stationary diverter at all times except when the heavier of such balls traverses the plate, so that lighter balls are undeflected by the diverter, and permitting deflection of the weighing plate when the weighing plate is traversed by a heavier ball so that such ball is deflected by the diverter.

* * * * *